United States Patent [19]

Frye et al.

[11] Patent Number: 4,624,206

[45] Date of Patent: Nov. 25, 1986

[54] FOLDABLE AUXILLIARY STEERING ARM FOR TROLLING MOTORS

[76] Inventors: Richard D. Frye, 900 Lime La., Marathon, Fla. 33050; John P. Huff, 778 Kindra Dr., Henderson,, Tenn. 38340; Rhodes H. Barnette, 3080 S. Highland, Jackson, Tenn. 38301

[21] Appl. No.: 721,452

[22] Filed: Apr. 9, 1985

[51] Int. Cl.[4] ..... B63H 21/17

[52] U.S. Cl. ..... 114/146; 440/6; 403/93; 74/480 B; 74/544; 74/531

[58] Field of Search ..... 114/144 R, 146, 162, 114/165; 440/6, 7, 113, 53, 63, 84, 87, 900; 74/492, 480 B, 480 R, 525, 531, 543, 544, 547; 403/91, 92, 93, 103, 87, 84

[56] References Cited

U.S. PATENT DOCUMENTS

| | | | |
|---|---|---|---|
| 1,519,246 | 12/1924 | Forshee et al. | 403/93 X |
| 2,478,858 | 8/1949 | Buske | 440/53 X |
| 2,747,425 | 5/1956 | Ohlau | 114/162 X |
| 4,311,470 | 1/1982 | Blanchard | 440/6 |
| 4,386,918 | 6/1983 | Matthews et al. | 440/7 |
| 4,397,200 | 8/1983 | Reynolds | 74/473 R |

*Primary Examiner*—Sherman D. Basinger
*Assistant Examiner*—Paul E. Salmon
*Attorney, Agent, or Firm*—Roylance, Abrams, Berdo & Goodman

[57] ABSTRACT

The invention provides, for conventional electric trolling motors, a steering arm which allows positive and convenient steering from positions spaced a substantial distance from the motor, can be adjusted to allow steering by one who is standing in the boat being powered by the trolling motor, and is foldable to a stowed position while still mounted on the trolling motor.

5 Claims, 12 Drawing Figures

FOLDABLE AUXILLIARY STEERING ARM FOR TROLLING MOTORS

This invention relates to handles especially useful as an auxilliary steering arm for an electric trolling motor of the type used to power small boats and canoes.

BACKGROUND OF THE INVENTION

It has become common practice to power small boats and canoes, particularly those used for fishing freshwater lakes, ponds and streams, by electric trolling motors which are powered by a rechargeable storage battery. Though such motors vary widely in type and design, a common type comprises a support column, a submersible motor-and-propeller unit mounted at one end of the support column, and a housing secured to the other end of the support column, suitable means being provided for securing the support column to the boat or canoe in vertical position, with the motor-and-propeller unit near or below the bottom of the boat or canoe and the housing located above the gunnels. Electrical leads run through the support column to the housing, and switch means are carried by the housing for controlling motor speed and selecting between forward and reverse. External electrical leads extend from the housing for connection to the storage battery.

The housings of such motors are provided with a short handle by which the entire motor can be turned about the axis of the support column for steering, and it is possible to mount the motor in such fashion that the handle, though short, can be reached by a person occupying a seat in the boat or canoe. But the short handle usually provided on such trolling motors is frequently not adequate. Thus, in the case of a canoe occupied by only one person, as is frequently the case when fishing, it is necessary either to provide frontal ballast or to have the single occupant in a position forward of the rear seat and, in the latter case, it is difficult to reach the standard short handle of the trolling motor. In the case of so-called "bass boats", which are larger and more stable that a canoe, the trolling motor is often mounted on the bow and is therefore in a location so far forward of the front seat of the boat that the usual short handle cannot easily be reached by one occupying the front seat. In the case of bass boats and other small outboard motor boats, it is also desirable to be able to steer the boat when standing, as well as when seated, and the short handles usually provided on electric trolling motors cannot be reached conveniently by one standing in the boat. Accordingly, prior-art workers have provided auxiliary steering arms of various types, as seen for example in the following U.S. Pat. Nos.: 2,903,903, Jaromy; 2,926,544, Carmichael; 3,174,357, Conklin; 3,274,849, Hanson; 3,456,525, Oldham; 3,955,438, Zakrzewski. However, though considerable attention has been given to the problem, there has been a continuing demand for improvement.

SUMMARY OF THE INVENTION

Auxilliary steering arms according to the invention can be attached easily to all conventional electric trolling motors of the type described, allow positive and convenient steering from a position spaced a substantial distance from the motor, can be adjusted to allow steering by one who is standing, and are foldable to a stowed position while still mounted on the trolling motor. Further, the invention provides an arm structure which is simple in construction, despite its variety of use positions, and is unusually inexpensive to manufacture.

Considered broadly, auxilliary steering arms according to the invention comprise first and second arm portions each having a first end and a second end, the first end of the first arm portion being adapted to be secured to the support column of the trolling motor in a location below the housing, and the first end of the second arm portion being pivotally connected to the second end of the first arm portion for movement from a first position, in which the second arm portion is in effect and extension of the first arm portion, to a stowed position, in which the two arm portions are adjacent to each other. Advantageously, the pivotal connection between the two arm portions is such that the second arm portion can be pivoted stepwise through a succession of positions and is releasably held in each such position. For example, according to one embodiment of the invention, the second arm portion is pivotable from its first position to a second position in which the second arm portion extends upwardly at 45° relative to the first arm portion, then to a third position in which the second arm portion is upright, then to a fourth position in which the second arm portion slants toward the trolling motor, thence to the stowed position as a fifth position. By rotational adjustment of the arm portions relative to the point of attachment to the support column of the motor, the plane in which such pivotal movement is accomplished can be horizontal rather than upright. Advantageously, the pivotal connection between the two arm portions includes a U-clamp secured to the second end of the first arm portion and having two spaced legs which project laterally from the first arm portion, a pivot member disposed between the legs of the U-clamp, and means mounting the pivot member on the legs of the U-clamp for rotation about an axis extending generally across the first end of the second arm portion, the first end of the second arm portion being connected to the pivot member. To provide the step-by-step pivotal movement of the second arm portion, the end portions of the legs of the U-clamp are formed with a plurality of cam faces, a shaft is connected to the pivot member and extends into the first end of the second arm portion, which is hollow, the first end of the second arm portion has an end face to engage the cam faces presented by the legs of the U-clamp, and the shaft carries spring means to urge the end face of the second arm portion into operative engagement with the cam faces.

IDENTIFICATION OF THE DRAWINGS

DETAILED DESCRIPTION OF THE INVENTION

Figure 1:
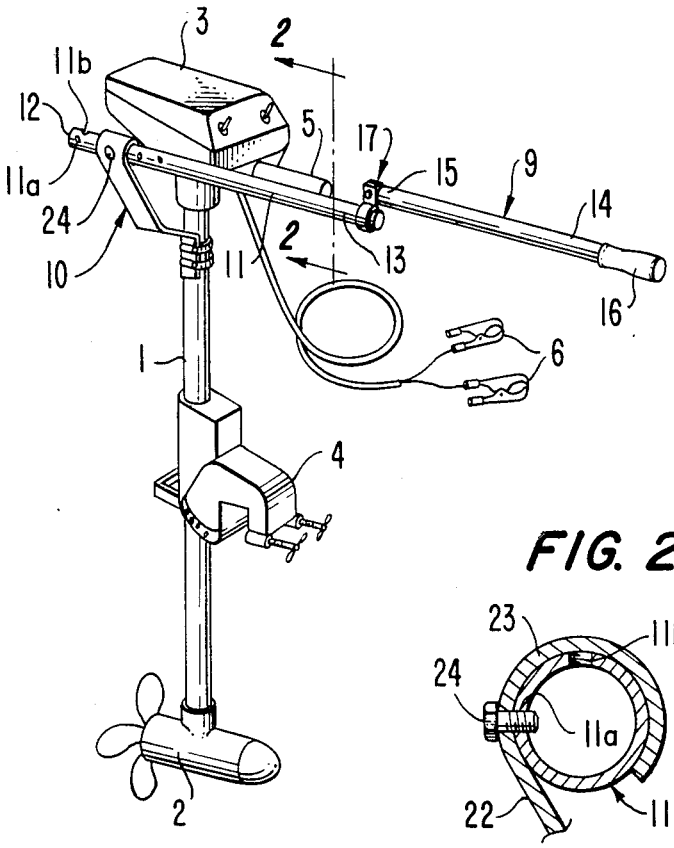
FIG. 1 is a perspective view of one conventional electric trolling motor with an auxilliary steering arm according to one embodiment of the invention attached thereto, the second arm portion of the auxilliary arm occupying its first position.
Figure 2:
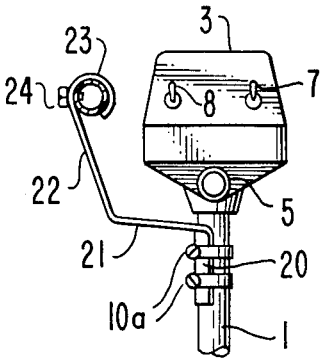
FIG. 2 is a view, partly in vertical cross section and partly in side elevation, taken generally on line 2—2, FIG. 1.

Typical Electric Trolling Motor To Which Auxilliary Arms According To The Invention Can Be Applied Referring to FIG. 1, it will be seen that a typical electric trolling motor comprises a straight hollow support column 1, a submersible motor-and-propeller unit 2 mounted on one end of column 1, a housing 3 secured to the opposite end of the support column, clamp means 4 for securing the support column to the boat or canoe to be powered, a short steering handle 5 permanently secured to and projecting forwardly from housing 3, and cables 6 for connecting the motor to a storage battery (not shown). As seen in FIG. 2, the front face of housing 3 carries a switch 7 for selecting between "off", "forward" and "reverse" operation, and a switch 8 for controlling the speed of the motor.

The Auxilliary Steering Arm Considered Broadly

According to the invention, the auxillliary steering arm indicated generally at 9 comprises a mounting bracket 10 secured at its lower end to support column 1 below housing 3 and projecting upwardly beside the housing, a first arm portion 11 having a first end 12 rigidly secured to the upper end of the mounting bracket and also having a second end 13, a second arm portion 14 having a first end 15 connected to the second end of the first arm portion and also having a second end 16, and a pivotal connection 17 connecting the first end of second arm portion 14 to the seconc end of the first arm portion. Pivotal connection 17 is so constructed and arranged that the second arm portion can be moved step-by-step from its first position, seen in FIG. 1 and in which the second arm portion extends generally in the same direction as the first arm portion so as to act as an extension thereof, and a stowed position, seen in FIG. 9 and in which the second arm portion extends back toward the tolling motor and is parallel to and adjacent to the first arm portion. FIGS. 1–9 show the steering arm so disposed that pivotal movement of the second arm portion is in a vertical plane. However, arm portion 11, and therefore arm portion 14, can be rotated relative to bracket 10 so that the pivotal movement of arm portion 14 occurs in a horizontal plane. Connection 17 is operative to retain the second arm portion in any of its adjusted positions in releasable fashion, as will be described in detail hereinafter. Since the upper end portion of bracket 10 is beside and spaced laterally from housing 3, and since first arm portion 11 extends generally parallel to the conventional handle 5, the front face of housing 3, with its switches 7 and 8, is always readily accessible, regardless of the position of arm portion 14.

The Mounting Bracket

Figure 2A:
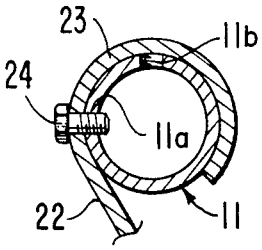
FIG. 2A is a fragmentary transverse sectional view, enlarged with respect to FIG. 2, taken on a line centered on the mounting bracket of the device shown in FIG. 1.

As seen in FIGS. 1–2A, mounting bracket 10 is an integral piece formed from an initially flat metal strip and including a lower end portion 20, an intermediate portion 21 and an upper end portion 22. Portion 20 is formed to have an arcuate transverse cross section such as to enable that portion to embrace the outer surface of support column 1 of the trolling motor, and the bracket is secured rigidly to the support column by two conventional screw operated band clamps 10*a*. The bracket is bent at the junction between portions 20 and 21 so that, with portion 20 clamped to support column 1, intermediate portion 21 projects laterally away from the support column at an obtuse angle, the length of the intermediate portion being such that the junction between the intermediate portion and upper end portion 22 is spaced a significant distance from the adjacent side of housing 3. The bracket is also bent at the junction between portions 21 and 22 in such fashion that portion 22 projects upwardly and away from housing 3. Typically, the included angle between portions 20 and 21 can be 95° and that between portions 21 and 22 can be 50°. Free end portion 23 of portion 22 is bent in circular fashion to embrace arm portion 11 and has an opening 23*a* extending radially through that part of circular portion 23 most distant from housing 3 so as to extend horizontally when support column 1 is vertical. Commencing immediately adjacent first end 12, arm portion 11 has a first set of radial threaded openings 11*a* and a second set of radial threaded opendings 11*b*, the openings of both sets being spaced lengthwise of the arm portion and the openings of the two sets being arranged in transversely aligned pairs spaced apart circumferentially of arm portion 11 by 90°. Arm portion 11 is secured to the mounting bracket by a screw 24 extending through opening 23*a* and engaged in a selected one of openings 11*a* and 11*b*. Thus, arm portion 11 can be secured to bracket 10 in either of two rotational positions which are 90° apart and in any of several positions spaced longitudinally along the arm portion.

The Pivotal Connection

Figure 5:
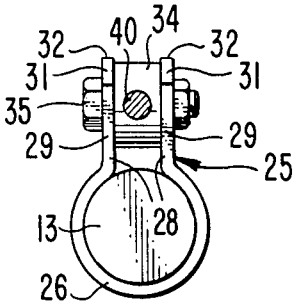
FIG. 5 is a transverse cross-sectional view taken generally on line 5—5, FIG. 3.
Figure 3:
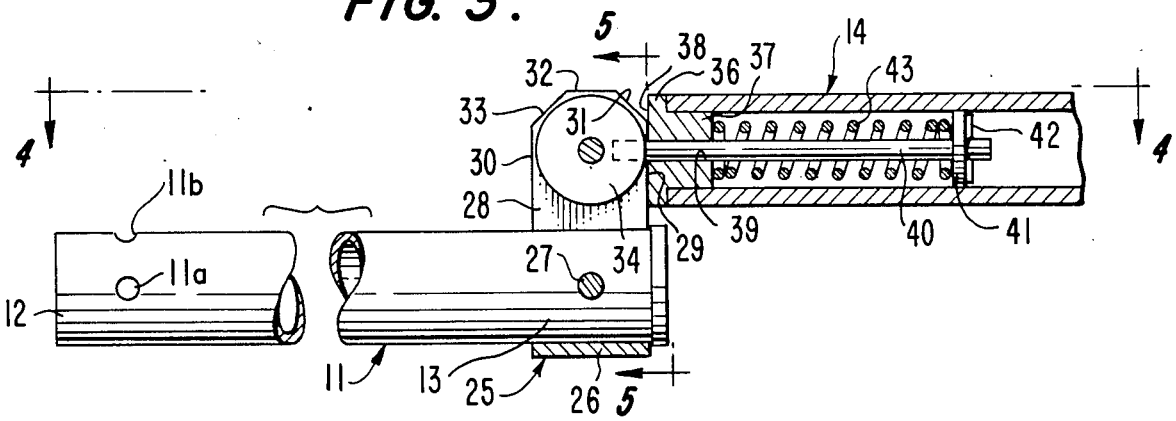
FIG. 3 is a view, partly in longitudinal cross section and partly in side elevation, taken at the pivotal connection between the first and second arm portions of the auxilliary steering arm of FIGS. 1–2A, with the second arm portion in its first position.
Figure 4:
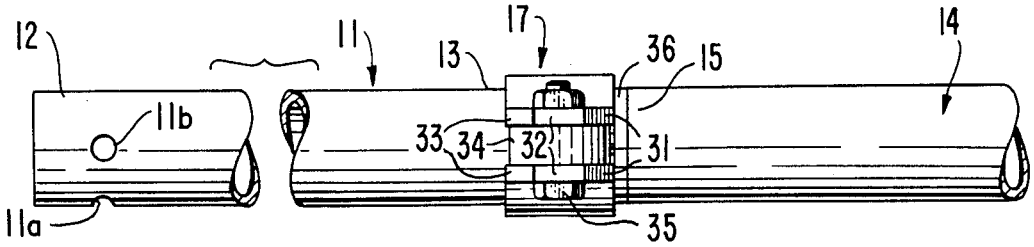
FIG. 4 is a top plan elevational view taken generally on line 4—4, FIG. 3.
Figure 6:
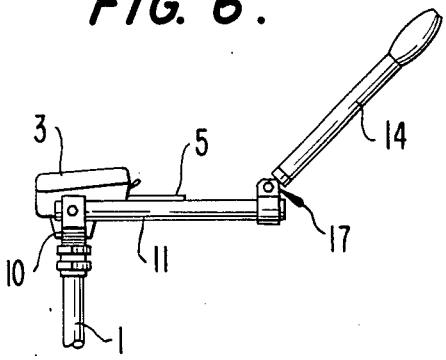
FIGS. 6–9 are side elevational views showing the second arm portion in different successive positions resulting from stepwise pivotal movement of the second arm portion relative to the first arm portion.
Figure 7:
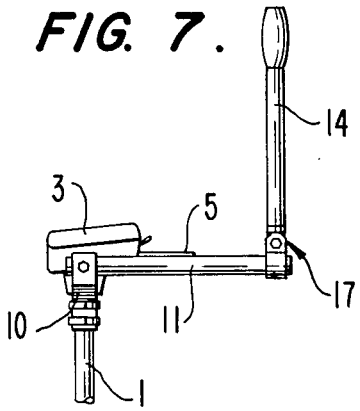
Figure 8:
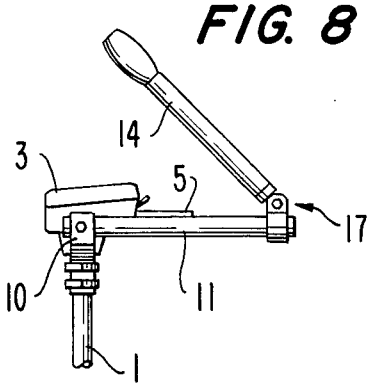

Pivotal connection 17 is shown in detail in FIGS. 3–5 and comprises a U-clamp 25. With end 13 of arm portion 11 being of circular transverse cross section, base 26 of clamp 25 extends for more than 180° and embraces end 13 in the manner seen in FIG. 5, the clamp being rigidly affixed to the arm portion, as by pin 27, FIG. 3. Legs 28 of clamp 25 are flat and parallel, projecting away from end 13 in such positions that the legs are vertical and extend upwardly from arm portion 11 when the trolling motor is in the normal operating position seen in FIG. 1 and screw 24 extends through opening 23*a* and is engaged in one of openings 11*a*. Legs 28 project horizontally to the left, as viewed in FIG. 1, when screw 24 is engaged in one of openings 11*b*.

Legs 28 are identical, side edges 29 and 30 forming two straight cam faces and the ends of the legs being cut away at each corner so as to present three additional cam faces 31–33. Faces 29 and 30 are mutually parallel and at right angles to the longitudinal axis of arm portion 11. Cam faces 31–33 are flat, face 31 extending at 45° to edge 29, face 32 being parallel to arm portion 11, and face 33 extending at 45° to edge 30. A cylindrical pivot member 34 is disposed between legs 28 and supported by a bolt 35 which extends through mutually aligned openings in the legs, the bolt extending at right angles to the planes of the flat legs and defining the axis of rotation of the pivot member. So that the cam faces will be free, the radius of curvature of member 34 is less than the radial distance from the pivotal axis of member 34 to the midpoints of cam faces 31–33, the pivotal axis being equidistant from all of the cam faces.

First end 15 of arm portion 14 is hollow and equipped with an end member 36 having a shank 37 secured within the tubular end 15, a transverse portion of member 36 providing a flat cam face 38 directed axially away from end 15, a through bore 39 extending through the center of face 38. Pivot member 34 has rigidly secured thereto a straight shaft 40 which extends radially with respect to the pivotal axis of member 34 and projects through the through bore 39 of end member 36, shaft 40 being markedly longer than shank 37. A stop washer 41 is slidably disposed on shaft 40 within tubular end portion 15, movement of the washer away from end member 36 being limited by a pin 42 secured to the shaft. A helical compression spring 43 is engaged between washer 41 and the shank of end member 36, the effect of the spring being to urge cam face 38 of end member 36 against selected pairs of the cam faces 29–33 presented by the legs of U-clamp 25, the particular ones of cam faces 29–33 engaged by can face 38 depending upon the pivotal position of arm portion 14 relative to arm portion 11. As will be clear from comparison of FIGS. 3 and 5, each of the five cam faces presented by one leg 28 of clamp 25 is paired with a like cam face presented by the other leg of the clamp. Thus, for example, the two cam faces 31 lie in a common plane.

Using The Auxilliary Steering Arm

Assuming that screw 24 is engaged in one of the openings 11*a*, second arm portion 14 can be pivoted to a first position, with cam face 38 of end member 36 engaging paired cam faces 29 of legs 28 of clamp 25, in which case arm portion 14, though offset above arm portion 11, extends away from and parallel to arm portion 11 as an effective extension thereof, the effective length of the steering arm depending upon which one of openings 11*a* is engaged by screw 24. When an upward force adequate to overcome the retaining bias of spring 43 is applied to handle 16, arm portion 14 can be pivoted upwardly until cam face 38 engages cam faces 31 and arm portion 14 therefore projects forwardly and upwardly at an angle of, e.g., 45° from arm portion 11. A further upward force will pivot arm portion 14 until cam face 38 engages cam faces 32 and arm portion 14 projects upwardly substantially vertically. A force applied to handle 16 in a direction to move arm portion 14 toward the trolling motor will now be effective to pivot arm portion 14 until cam face 38 engages cam faces 33 so that arm portion 14 is restrained to a position in which it slants upwardly and rearwardly at, e.g., 45° relative to arm portion 11. Finally, a further rearward force on arm portion 14 will be effective to swing arm portion 14 to its stowed position, in which cam face 38 is engaged with cam faces 30. The successive positions are shown in FIG. 1 and FIGS. 6–9.

Figure 10:
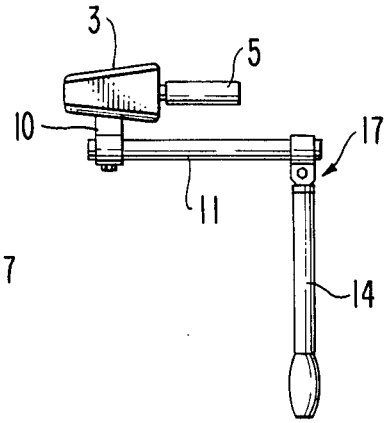
FIG. 10 is a top plan elevational view showing the second arm portion in the same sequential position as in FIG. 7 but with the arm portions having been rotated 90° counterclockwise, as viewed in FIG. 2, so that pivotal movement of the second arm portion occurs in a horizontal plane.
Figure 9:
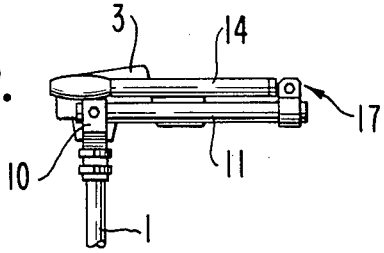

Assuming that support column 1 of the trolling motor is vertical, all of the stepwise pivotal movements shown in FIGS. 1 and 6–9 occur in a vertical plane. By removing screw 24, rotating shaft portion 11 counterclockwise 90° relative to the support bracket, and then engaging screw 24 in one of openings 11*b*, the stepwise pivotal movements described with reference to FIGS. 1 and 6–9 will occur in a horizontal plane with arm portion 14 swinging generally across the boat. Thus, the position of arm portion 14 achieved by moving arm portion 14 until cam face 38 engages cam faces 32 is illustrated in FIG. 10. Provision for pivotal movement in a horizontal, rather than a vertical, plane is desired by some when, for example, the trolling motor is mounted on a gunnel of a relatively wide beam boat.

The strength of compression spring 43 is such that, whenever cam face 38 of end member 36 is engaged with any of the pairs of cam faces 29–33, arm portion 14 is restrained to the corresponding position, relative to arm portion 11, in such fashion that that position will be retained under all conditions normal to use of the auxilliary steering arm to turn the trolling motor about the axis of support column 1 for steering purposes. Whenever arm portion 14 is pivoted from one position to the next, the force applied to accomplish such pivotal motion must be adequate to overcome the opposing force which is applied by spring 43 as cam face 38 engages the angular junction between the two respective ones of cam faces 29–30. Since the straight cam faces 29–33 are of significant length, and since cam face 38 is flat ant of a diameter substantially greater than the length of each cam face 29–33, compression spring 43 need not be unduly strong to retain arm portion 14 in each of its pivoted positions under the forces applied during use of the auxilliary arm for steering purposes.

It will be apparent that auxilliary arm 9 allows the user of a trolling motor to be seated further from the trolling motor than is true when only the conventional handle 5 is availble to manipulate the trolling motor for steering. Further, when arm portion 14 is so adjusted as to extend upwardly, either slanting forwardly, extending vertically, or slanting rearwardly, the auxilliary arm allows easy and positive manipulation of the trolling motor for steering when the person using the motor is standing in any of various positions. Provision of the stowed position provides compactness and allows the trolling motor to be operated in more conventional fashion without removal of the auxilliary arm. Regardless of the position of arm portion 14, housing 3 of the trolling motor is left completely accessible for manipulation of the control switches and, when the conventional steering handle 5 is also rotatable for speed control, for manipulation of that handle.

Figure 11:
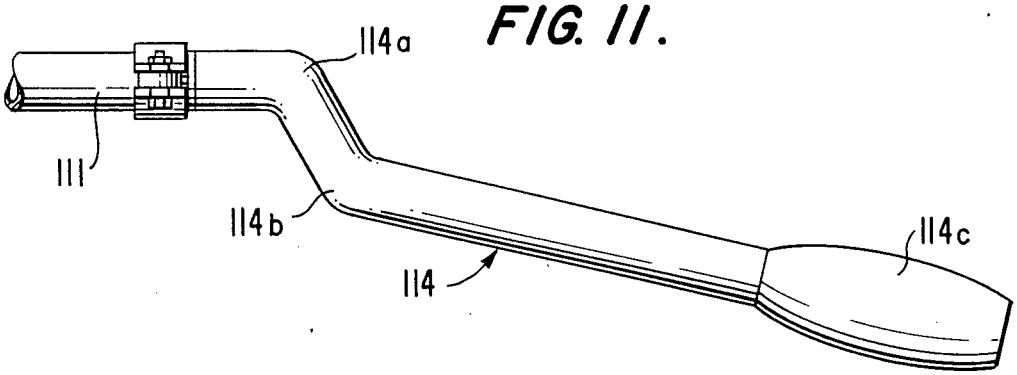
FIG. 11 is a fragmentary top plan elevational view illustrating a modified form of the second arm portion of the embodiment shown in FIGS. 1–9.
Figure 12:
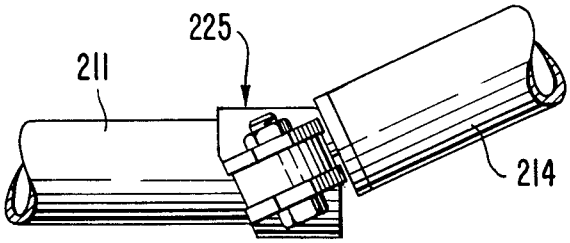
FIG. 12 is a fragmentary top plan elevational view similar to FIG. 4 but showning a modified form of pivotal connection according to the invention.

The Modifications Shown In FIGS. 11 and 12

It will be apparent that, as seen in FIG. 11, the second arm portion can be offset to bring its end nearer the center of the boat when, e.g., the motor is mounted on the gunnel. Thus, arm portion 114 can be bent at 114*a* and 114*b* so that the free end portion 114*c* is considerably offset from arm portion 111 in an inboard direction away from the housing of the trolling motor. When pivoted to the stowed position, offset portion 114*c* is spaced even further from the housing of the trolling motor and therefore is not in the way of manipulation of the conventional controls.

Similarly, in cases where it is desirable to have arm portion 214, FIG. 12, spaced more toward the same side of the boat or canoe at which the trolling motor is located, U-clamp 225 of the pivotal connection can be so constructed that the pivotal axis for arm 214 extends at an angle to the longitudinal axis of arm portion 211, the angular disposition of the pivotal axis being such that, when in its full forward position, arm portion slants forwardly in front of the trolling motor. Then, when arm portion 214 is pivotaed to its stowed position, that arm portion slants away from the housing of the trolling motor and is therefore completely out of the way so far as conventional operation of the trolling motor is concerned.

What is claimed is:

1. For use with an electric trolling motor of the type comprising a support column to be secured to a boat with the support column generally upright so as to have an upper end and a lower end, a submersible motor-and-propeller unit mounted on the lower end of the support column, and a housing secured to the upper end of the support column, a steering arm comprising the combination of a mounting bracket comprising a lower end portion of such shape as to be capable of being fitted against a portion of the support column of the trolling motor adjacent the housing, securing means for securing the lower end portion of the mounting bracket to the support column, an upper end portion having a free end portion which extends generally circularly and has an opening which is radial with respect to the axis of curvature of the circularly extending portion and is directed away from the housing of the trolling motor when the mounting bracket is secured to the support column, and an intermediate portion of such shape and length that, when the lower end portion of the mounting bracket is secured to the support column of the trolling motor, the upper end portion of the mounting bracket is spaced laterally from the housing of the trolling motor;

a first arm portion having first and second ends, the circularly extending free end portion of the mounting bracket embracing the first arm portion, and the first arm portion having at least one radial opening capable of alignment with the opening in the circularly extending free end portion of the mounting bracket, the first arm portion being secured to the mounting bracket by a fastener extending through the opening in the mounting bracket and engaged in the opening in the first arm portion;

a second arm portion having first and second ends; and pivot means connecting the first end of the second arm portion to the second end of the first arm portion and operative to allow the second arm portion to be pivoted relative to the first arm portion from a first position, in which the second arm portion extends generally in the same direction as does the first arm portion, to a stowed position in which the second arm portion lies adjacent to the first arm portion.

2. The combination defined by claim 1, wherein the first arm portion has a plurality of radial openings spaced apart lengthwise of the arm portion and each capable of being aligned with the opening in the mounting bracket, whereby the effective length of the first arm portion can be adjusted by moving the arm portion axially relative to the mounting bracket to bring a selected one of the openings in the arm portion into position to receive said fastener.

3. The combination defined by claim 1, wherein the first arm portion has at least one pair of radial openings spaced apart circumferentially of the arm portion; and said fastener is capable of being releasably engaged in either opening of said pair of openings when the arm is adjusted rotationally relative to the mounting bracket to bring a selected opening of said pair into alignment with the opening in the mounting bracket.

4. The combination defined by claim 3, wherein the first arm portion has a plurality of said pairs of radial openings and the pairs of radial openings are spaced apart lengthwise of the arm portion.

5. For use with an electric trolling motor of the type comprising a support column to be secured to a boat with the support column generally upright so as to have an upper end and a lower end a submersible motor-and-propeller unit mounted on the lower end of the support colum, and a housing secured to the upper end of the support column, a steering arm comprising the combination of a mounting bracket comprising a lower end portion of such shape as to be capable of being fitted against a portion of the support column of the trolling motor adjacent to and below the housing, securing means for securing the lower end portion of the mounting bracket to the support column, an upper end portion, and an intermediate portion of such shape that, when the lower end portion of the mounting bracket is secured to the support column of the trolling motor in a location adjacent to and below the housing, the upper end portion of the mounting bracket is spaced laterally from and beside the housing of the trolling motor;

a first arm portion having first and second ends;

a second arm portion having first and second ends;

the first end of the first arm portion being rigidly secured to the upper end portion of the mounting bracket in such fashion that, when the mounting bracket is operatively secured to the support column of the trolling motor and the trolling motor is operatively mounted on a boat, the first arm portion projects generally laterally from the support column and above the boat; and pivot means connecting the first end of the second arm portion to the second end of the first arm portion and operative to allow the second arm portion to be pivoted relative to the first arm portion from a first position, in which the second arm portion extends generally in the same direction as does the first arm portion, to a stowed position in which the second arm portion lies adjacent to the first arm portion.

* * * * *